United States Patent [19]

Senor

[11] Patent Number: 4,458,231

[45] Date of Patent: Jul. 3, 1984

[54] PROTECTOR APPARATUS FOR DYNAMOELECTRIC MACHINES

[75] Inventor: Ronald E. Senor, North Attleboro, Mass.

[73] Assignee: Texas Instruments Incorporated, Dallas, Tex.

[21] Appl. No.: 330,750

[22] Filed: Dec. 14, 1981

[51] Int. Cl.[3] ..... H01H 61/02

[52] U.S. Cl. ..... 337/107; 337/113

[58] Field of Search ..... 337/102, 103, 107, 112, 337/113

[56] References Cited

U.S. PATENT DOCUMENTS

| | | | |
|---|---|---|---|
| 3,194,924 | 7/1965 | Moksu et al. | 337/113 X |
| 4,015,229 | 3/1977 | Senor et al. | 337/102 X |
| 4,136,323 | 1/1979 | D'Entremont et al. | 337/102 X |
| 4,224,591 | 9/1980 | Senor | 337/102 |

*Primary Examiner*—George Harris

*Attorney, Agent, or Firm*—John A. Haug; James P. McAndrews; Melvin Sharp

[57] ABSTRACT

A motor protector having a thermally and electrically conductive housing with a closed end and an opened end and defining a switch cavity therein is hermetically sealed with a header assembly. The header assembly has an outer margin circumscribing a central electrically insulative glass portion through which extends an electrically conductive terminal pin. A thermostatic assembly is mounted on the distal free end portion of the pin within the cavity and includes a heater element which extends from the pin toward the closed end of the housing. A snap-acting thermostatic element is cantilever mounted to the heater intermediate the ends of the heater and has a movable contact disposed on the distal free end thereof. A stationary contact is disposed within the cavity and is physically and electrically connected to the housing adjacent the closed end thereof on a relatively flat shelf formed in the wall of the housing. The movable contact is adapted to move into and out of engagement with the stationary contact upon the occurrence of preselected temperature conditions of the thermostatic element. The housing is configured to provide rotational orientation to facilitate assembly thereof and in addition so that it can be inserted into a pocket formed in the windings of a dynamoelectric machine of various ratings or placed on the outer peripheral portion of the windings in close thermal contact therewith.

8 Claims, 10 Drawing Figures

PROTECTOR APPARATUS FOR DYNAMOELECTRIC MACHINES

This invention relates generally to dynamoelectric machines and more particularly to protective devices for such machines.

In copending application, assigned to the assignee of the instant invention Ser. No. 262,843 filed May 12, 1981, now U.S. Pat. No. 4,376,926, and Ser. No. 52,897, filed June 2, 1979, which in turn is a continuation of Ser. No. 856,707, filed Dec. 2, 1977, a motor protector is disclosed comprising a tubular housing of a deformable, electrically and thermally conductive metal material having an opened end and a closed end. A stationary contact is welded directly to the housing inside the housing adjacent to the closed end thereof. A header plate is secured to the opened housing end for hermetically sealing the housing and a pair of terminal pins extend through the plate in sealed, electrically insulated relation to the plate to extend into the housing in spaced, electrically insulated relation to each other and to the housing. A first heater element is welded to one of the terminal pins to extend in cantilever relation from the pin along the length of the tubular housing. A thermally responsive snap-acting bimetallic member has one end welded to the first heater element and has a movable contact at its opposite end, the bimetallic member extending in cantilever relation from the first heater element to normally dispose the movable contact in engagement with the stationary contact adjacent the closed end of the housing for closing a circuit. The bimetallic member is movable to disengage the contacts and open the circuit when heated to a selected temperature. A second heater element is connected between the second terminal pin and the thermally responsive member and has a portion extending along the opposite side of the bimetallic member in heat transfer relation therewith.

The motor protector housing is adapted to be connected to a terminal in a power circuit while the first and second terminals are connected to the run and start windings respectively of an electrical motor for normally energizing the motor windings through the protector circuit and for directing the run and start winding current through the respective first and second heater elements. Under normal motor operating conditions, the heaters generate insufficient heat to actuate the bimetallic member to open the protector circuit. However, in the occurrence of an overload current in either motor winding, the heaters generate sufficient heat to actuate the bimetallic member to open the circuit for protecting the motor against excessive winding temperature. The heater elements, bimetallic member and the contacts are arranged within the housing in such a way that the housing is adapted to be deformed adjacent the closed end after final assembly of the protector for calibrating the protector to open the protector circuit when the bimetallic member is heated to a desired temperature.

While the above described protector is very effective in providing over-current protection for both start and run windings in a motor as well as over-temperature protection, there is a need for a lower cost, single heater protector adaptable for use with various current ratings of dynamoelectric machines and conducive to being mounted either in a pocket formed in the windings of the machine, or in contact with the outer surface area of the windings. Further, in order to facilitate efficient assembly of a single heater, single terminal pin protector, means must be provided to permit angular orientation of the housing relative to the header.

It is therefore an object of this invention to provide a low cost temperature responsive device which is simple yet reliable to protect dynamoelectric machines from the deleterious effects of over-temperature by interrupting operation of the machine upon the occurrence of over-current or over-temperature conditions; another object is the provision of such a protector which is compact in size being configured to fit within or on the windings of different current rated dynamoelectric machines in optimum heat transfer relation thereto; another object is the provision of a hermeticallly sealed protector capable of withstanding pressures in the order of 2000 psi for use in rotary compressors and the like. Yet another object is to provide a protector which, while housing different thermostatic assemblies, each tailored to a selected current rating of dynamoelectric machines, comprises a housing and header assembly commonly used for each of the thermostatic assemblies and which can readily be accommodated within the confines of the windings assemblies of the respective machines. Still another object is the provision of means to conveniently allow angular orientation of the header assembly relative to the housing during assembly thereof.

Briefly, the protector made in accordance with the present invention comprises a thermally and electrically conductive housing with a closed end and an opened end and defining a switch cavity therein which is hermetically sealed with a header assembly. The header assembly is hermetically attached to the housing to close its opened end and mounts an electrical terminal pin in electrically insulated relation to the housing. The terminal pin extends into the switch cavity and mounts thereon in cantilever fashion a heater element which extends toward the closed end of the housing. One end of a snap-acting thermostatic element is attached to the heater intermediate its ends and in turn extends in cantilever fashion toward the closed end of the housing. A movable contact is mounted on the free end of the thermostatic element and is adapted to move into and out of engagement with a stationary contact mounted directly on the wall of the housing adjacent the closed end thereof. The housing is formed with a generally flat shelf adjacent its closed end to receive thereon the stationary contact. The housing is formed in the general configuration of an elliptical cylinder having a major axis which is determined by the spacing required for electrical separation between the thermostatic assembly and the housing wall for use with a first range of current ratings of dynamoelectric machines. The elliptical configuration permits the placement of different current rated thermostatic assemblies (heater and thermostatic element) for use with both the first range and a second lower range of current ratings of dynamoelectric machines in the same housing without increasing the space required for mounting the protector in the windings in the radial direction between the inner and and outer surfaces of the stator. Additionally, this configuration allow angular orientation of the housing relative to the header to facilitate automated assembly of the protector. In the previously described two heater protector this orientation was obtained by means of the two pins of the header.

Other objects, advantages and details of the protector made in accordance with the invention appear in the following detailed description of the preferred embodiment of the invention, the detailed description referring to the drawings in which.

Figure 1:
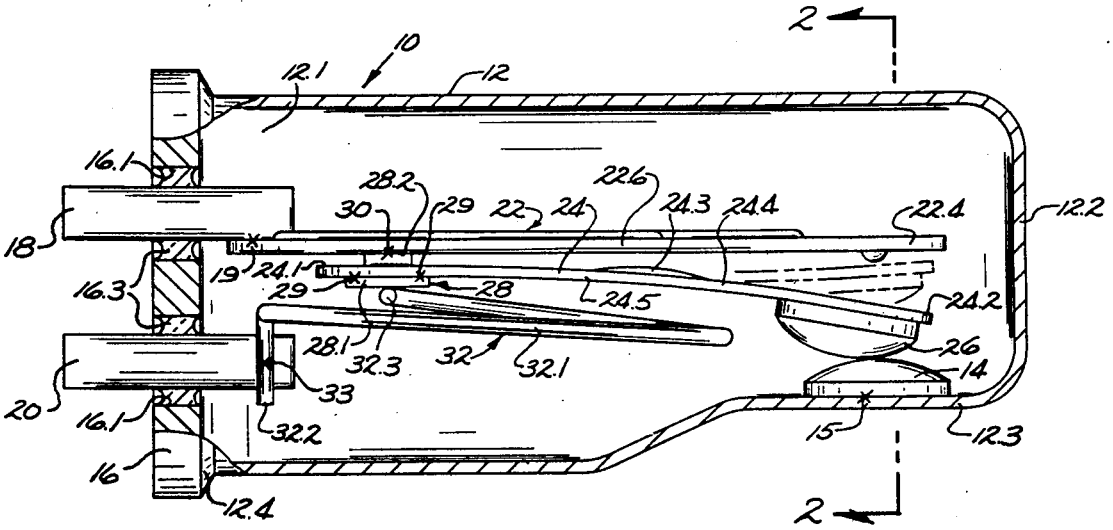
FIG. 1 is a cross sectional front view taken through the longitudinal axis of a two heater protector as described in the copending application referred to supra.
Figure 2:
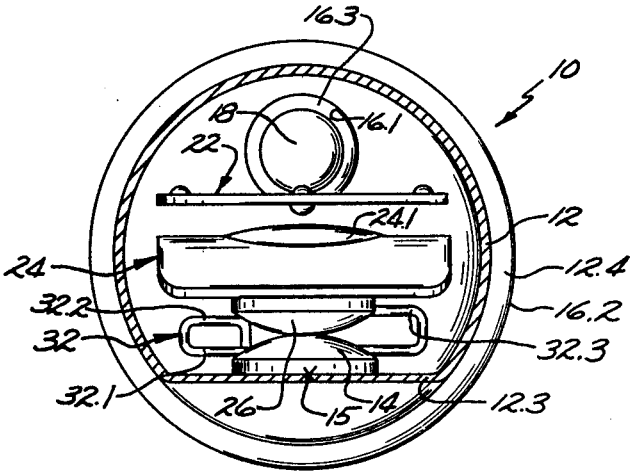
FIG. 2 is a cross sectional view taken on lines 2—2 of FIG. 1.

Referring to the drawings, numeral 10 in FIGS. 1 and 2 indicates a motor protector as described in my copending application and includes a generally circular cylindrical or tubular housing 12 having an opened end 12.1 and a closed end 12.2, the housing preferably having a shelf or stepped portion 12.3 adjacent the closed housing end. The housing is formed of a deformable, electrically and thermally conductive metal material such as low carbon steel and preferably has a flared rim 12.4 adjacent its opened end. A stationary contact 14 of a material such as silver cadium oxide or the like having a high electrical conductivity, low contact surface resistance, and good resistance to contact welding and arc erosion is welded as indicated at 15 directly to the shelf 12.3 of the housing adjacent to the closed housing end. A header plate 16, also preferably formed of low carbon steel or the like has a pair of openings 16.1 therein and has its perimeter welded or otherwise secured to the housing at the opened housing end for hermetically sealing the header plate to the housing. A pair of terminal pins 18 and 20, preferably formed with a copper core and having a steel cladding thereabout, are disposed in the respective header plate openings and are secured therein in hermetically sealed, electrically insulated relation to the header plate by conventional glass sealing means or the like as indicated at 16.3 in FIG. 1, whereby the pins extend into the protector housing.

A first electrical resistance heater element 22 is welded or otherwise secured to one terminal pin 18 as indicated at 19 of FIG. 1 to extend in cantilever relation from the pin to extend longitudinally a substantial part of the length of the tubular housing 12. The heater element is preferably formed of a suitably rigid, electrically conductive material such as cold rolled steel or the like having a desired electrical resistivity, whereby the heater element will generate a given heat output in response to a given level of electrical current passing through the element.

A thermally responsive snap-acting bimetallic element 24 has one end 24.1 thereof secured to the first heater element 22 in any conventional manner so that the member extends in cantilever relation from the first heater and has mounted at its free distal end a movable electrical contact 26, preferably formed of the same material as contact 14. Contact 26 is normally in circuit closing engagement with stationary contact 14. The thermally responsive element is of conventional type having layers of metal of relatively high and relatively low coefficients of thermal expansion bonded together and having a dished portion 24.3 therein, whereby the element is normally adapted to hold contact 26 in engagement with the contact 14 to close a circuit but, when heated to a selected temperature, is adapted to invert its dished portion and to move the movable contact with snap-action to the position indicated by broken lines 26*a* in FIG. 1 to disengage contact 14 for opening the circuit. When element 24 subsequently cools to a selected level below the selected temperature, the element is adapted to return to its original closed circuit position with snap action as will be understood. The thermally responsive element 24 is preferably secured to the first heater element by means of a conventional weld button 28, such button having a head 28.1 welded to the element as indicated at 29 and having a shank 28.2 which extends through an aperture (not shown) in end 24.1 of the thermally responsive element and which is welded to the first heater as indicated at 30.

First heater element 22 has a portion 22.6 which extends along one face 24.4 of the thermally responsive element in closely spaced, heat-transfer relation to the element at a location between element 24 and the housing 12.

A second heater element 32 is disposed between the housing and face 24.5 of thermally responsive element 24 opposite to face 24.4. The second heater is electrically connected between the second terminal pin 20 and thermally responsive element 24 and has a portion which extends along face 24.5 of thermally responsive element 24 in closely spaced heat transfer relation to the element. Heater element 32 may comprise a wire of nichrome alloy or the like having a selected electrical resistivity, the wire having one end 32.2 welded to the terminal pin 20 as indicated at 33 and having its opposite end 32.3 welded to the weld button 28 electrically connected to the thermally responsive member.

With particular reference to FIGS. 3–8 a simplified single heater protector 40 is shown which is readily adapted for use with different current rated dynamoelectric machines, either within a pocket formed in the windings or on an outer surface thereof in optimized heat transfer relation with the windings. Protector 40 comprises a generally tubular housing 42 having an opened end 42.1 and a closed end 42.2 and preferably having a shelf portion 42.3. The housing is formed of a deformable, electrically and thermally conductive material such as cold rolled steel used for housing 12 of protector 10.

A header plate 44, also preferably formed of low carbon steel or the like, has a single opening 44.1 and has its perimeter welded or otherwise secured to a flared portion 42.4 at the opened end 42.1 of the housing. A single terminal pin 46, preferably formed of the same material as pins 18 and 20 of protector 10, is disposed in the header plate and is secured therein in hermetically sealed, electrically insulated relation to the header plate by conventional glass sealing means or the like as indicated at 44.2 whereby the pin extends into a switch cavity 42.5 in the protector housing.

Figure 3:
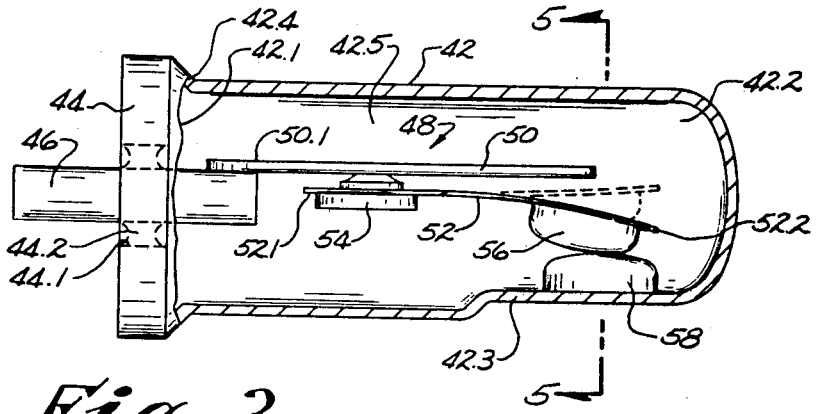
FIG. 3 is a cross sectional view similar to FIG. 1 of a protector made in accordance with the present invention.
Figure 4:
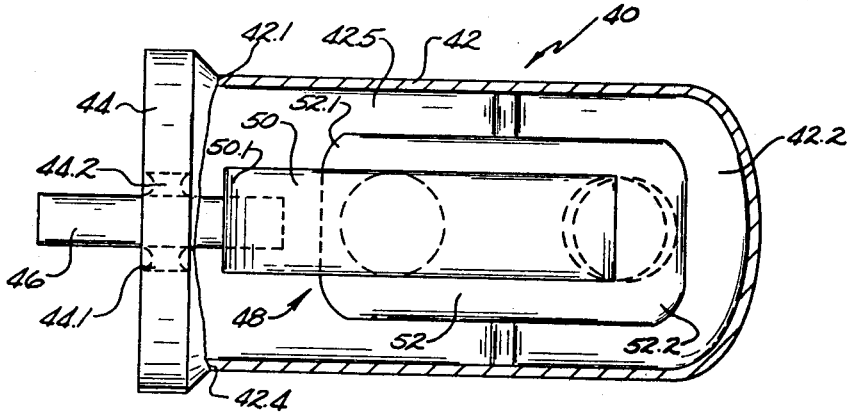
FIG. 4 is a top cross sectional view of the protector shown in FIG. 3.
Figure 5:
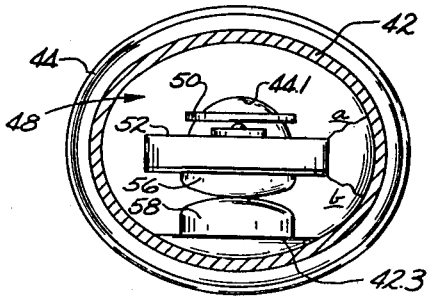
FIG. 5 is a cross sectional view taken on lines 5—5 of FIG. 3.

As seen in FIGS. 3–5, a thermostatic assembly 48 is disposed within switch cavity 42.5 and comprises a heater element 50 formed of any suitable material having selected electrical resistivity, such as cold rolled steel. Heater element 50 is in the form of an elongated plate having one end 50.1 secured to pin 46, as by welding, in cantilever relation to the pin so that the heater extends toward closed end 42.2 of the housing. A snap-acting thermostatic bimetallic element 52, in the form of a generally rectangular strip of bimetal having a portion formed into a dished configuration, extends from heater 50 in heat transfer relation thereto. Thermostatic element 52 has one end 52.1 secured to and in electrical connection with heater 50 intermediate its ends, as by welding through weld button 54. At the opposite end 52.2 of the thermostatic element a movable contact 56 is mounted in a conventional manner. Thermostatic element 52 extends from heater 50 in cantilever relation thereto toward closed end 42.2 of the housing to dispose movable contact 56 so that at normal operating conditions of the dynamoelectric machine with which protector 40 is used it is in engagement with a stationary contact 58 mounted in a conventional manner on shelf 42.3 of the housing. Upon heating of thermostatic element 52 to a selected temperature, it will snap to an opposite configuration as shown in dashed lines in FIG. 3 with the contacts out of engagement, to thereby open the electrical circuit formed between pin 46, heater 50, thermostatic element 52, the contacts, housing 42 and header plate 44. The device can be calibrated in the same manner as protector 10 by displacing shelf 42.3 to change the position of the stationary contact.

Housing 42, as best seen in FIG. 5, is configured generally as an elliptical cylinder having a major axis determined by the spacing a and b noted in the figure required by standards promulgated by various code making agencies for electrical separation between the thermostatic element and the housing wall for use with a particular current rated dynamoelectric machine, for example in the 15–60 ampere range.

Figure 6:
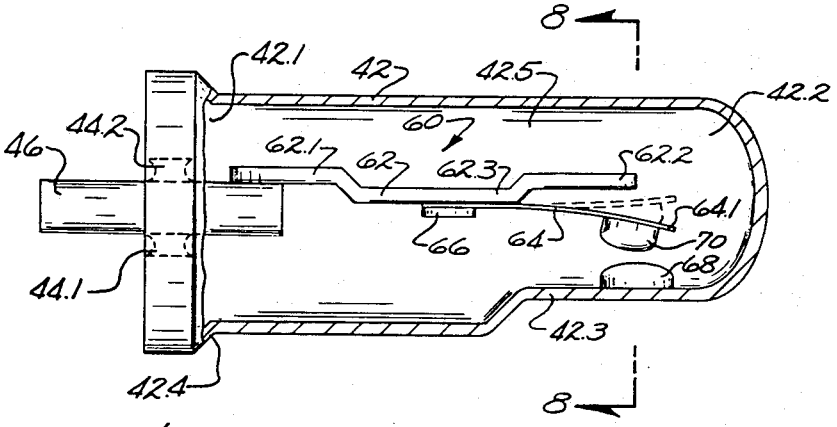
FIG. 6 is a cross sectional view similar to FIG. 3 of a protector made in accordance with the invention but housing a different current rated thermostatic assembly than that shown in FIG. 3.
Figure 7:
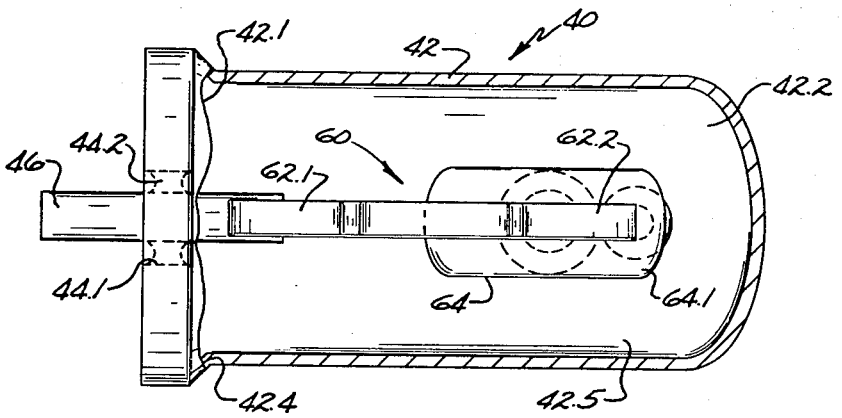
FIG. 7 is top a cross sectional view of the protector shown in FIG. 6.
Figure 8:
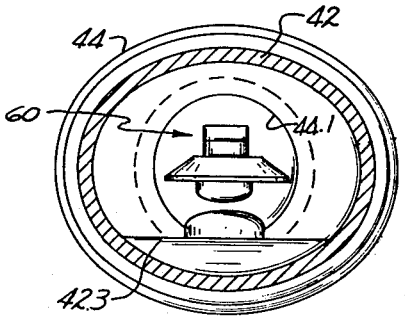
FIG. 8 is a cross sectional view taken on lines 8—8 of FIG. 6.

FIGS. 6–8 show protector 40 provided with thermostatic assembly 60 to adapt protector 40 for use with dynamoelectric machines having a different, lower, current range than that for which thermostatic assembly 48 is useful. For example assembly 60 may be used with dynamoelectric machines in the 5–15 ampere range. Thermostatic assembly 60 comprises a heater 62, similar to heater 50 but of a narrower configuration to adapt it to generate the desired level of heat output at the lower current ranges. Heater 62 has one end 62.1 secured to pin 46, as by welding, and an opposite end 62.2 which extends from pin 46 in cantilever fashion toward closed end 42.2 of the housing. Heater element 60 is shown to have an offset central portion 62.3 from which a snap-acting thermostatic element 64 is mounted as by welding employing welding tab 66. The offset portion of end 62.2 provides room for the thermostatic element to move into its opened (dashed line in FIG. 6) configuration. The symmetrical configuration allows either end of heater 60 to be welded to pin 46, as in FIGS. 3–6, to thereby facilitate assembly of the device.

Figure 9:
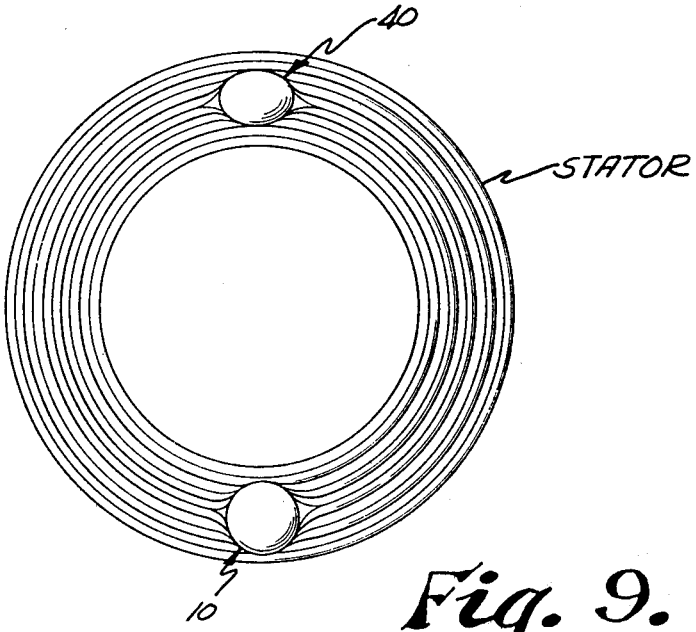
FIG. 9 is a diagramatic view of the stator of a dynamoelectric machine in which a protector of the type shown in FIGS. 1 and 2 and a protector made in accordance with the present invention are both mounted by embedding them in the windings.
Figure 10:
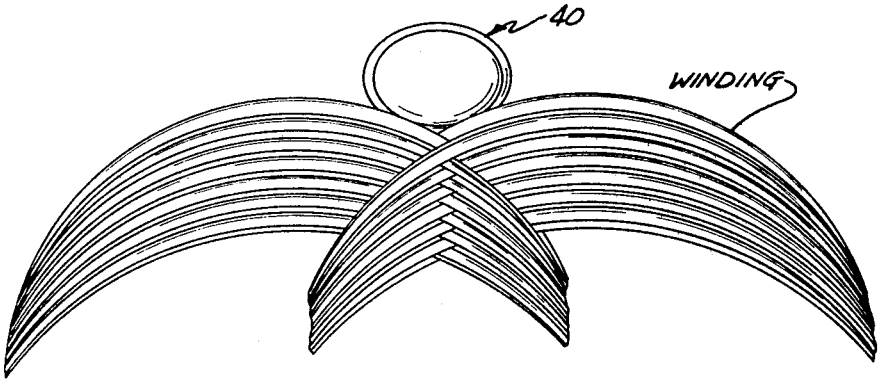
FIG. 10 is a diagramatic view of a portion of a winding on the outer surface of which a protector made in accordance with the present invention is placed.

Even though the major axis of housing 42 may be longer than required for use with thermostatic assembly 60, protector 40 will nevertheless be sufficiently compact to fit within pockets formed in the stator windings of the smaller current range dynamoelectric machines due to the elliptical configuration of housing 42. In this respect reference may be had to FIG. 9 which illustrates the advantage that the elliptical configuration of protector 40 offers in using less space in the radial direction between the inner and outer surfaces of the stator compared to the circular cylindrical configuration of protector 10 having the same spacing between the thermostatic assembly and the housing. An elliptically shaped housing also allows more control over placement of the protector in the windings in such a manner that the magnetic field established within the windings will act upon the arc created between the contacts of the protector upon opening and closing thereof in a manner contemplated by the design of the protector. That is, the arc can be directed to undesirable portions of the housing if the protector is not oriented as desired relative to the magnetic field. Provision of the elliptical configuration allows more control over this than is provided with a circular cylindrical housing. Another advantage can be seen from FIG. 10. In the event that it is desired to mount protector 40 on the outer surface of windings, the elliptical configuration provides more heat transfer surface than is obtained with a circular cylindrical shape to thereby make the device respond more quickly to over temperature conditions of the winding. Yet another advantage may be seen in considering the assembly of the protector 40. It will be noted that in assembling protector 10 angular orientation of the housing 12 relative to header 16 may be achieved by using shelf 12.3 as a reference surface for the housing and by using pins 18 and 20 as a reference for the header so that the header and housing will be welded together with the correct orientation with movable contact 26 movable into and out of engagement with stationary contact 14. With respect to protector 40 which has only a single terminal pin, the elliptical configuration provides the necessary reference to insure correct angular orientation of the parts relative to one another.

It should be understood that although particular embodiments of the protector of this invention have been described by way of illustrating this invention, the invention includes all modifications and equivalent of the disclosed embodiments falling within the scope of the appended claims.

I claim:

1. A thermostatic switch adapted to be thermally coupled to the windings of a dynamoelectric machine comprising a housing of a thermally and electrically conductive material, the housing being generally cylindrical in configuration and having a first opened end and a second closed end, and defining a switching cavity therein, a header received at and closing the first opened end, the header provided with and outer peripheral margin hermetically attached to the housing, an aperture formed in a central portion of the header and an electrically conductive pin member extending through the aperture into the switching cavity in electrical insulative relation to the header margin, a thermostatic assembly including a thermostatic element mounted on the pin and including a movable contact mounted on the thermostatic element, a stationary contact disposed in the switching chamber supported by and in electrical connection with the housing, the movable contact adapted to move into and out of engagement with the stationary contact at predetermined temperature conditions of the thermostatic element characterized in that the cylindrical housing is generally elliptical having a major axis determined by the spacing required between the housing and a thermostatic assembly selected for use with a first range of current ratings of dynamoelectric machines the housing being useful to house a thermostatic assembly selected for use with both the first range of current ratings and a second lower range of current ratings of dynamoelectric machines, the elliptical configuration providing a reference to enable angular orientation of the housing relative to the header to facilitate assembly of the switch.

2. A thermostatic switch according to claim 1 in which a shelf is formed in the housing wall adjacent to the closed end, the shelf serving as a seat for the stationary contact.

3. A thermostatic switch according to claim 1 in which the thermostatic assembly comprises an elongated heater having first and second ends, the first end secured to the pin member, the second end disposed adjacent the closed end of the housing, and the thermostatic element is an elongated, snap-acting element having a first end cantilever mounted to the heater intermediate its first and second ends, the thermostatic element having a second end mounting the movable contact.

4. A thermostatic switch according to claim 3 in which the heater element is symmetrically configured whereby either the first or second end can be secured to the pin member.

5. A thermostatic switch adapted to be thermally coupled to the windings of a dynamoelectric machine comprising a housing of thermally and electrically conductive material, the housing being generally cylindrical in configuration and having a first opened end and a second closed end, and defining a switching cavity therein, a header received at and hermetically closing the first opened end of the housing and an electrically conductive pin member extending through an aperture in the header in electrically insulative relation with the header, the pin member extending into the switching cavity, a thermostatic assembly comprising an elongated heater element having first and second ends, the first end secured to the pin member, the heater extending from the pin member toward the closed end of the housing, a thermostatic element having a first end cantilever mounted to the heater intermediate the first and second ends thereof, a movable contact mounted on an opposite end of the thermostatic element, a stationary contact disposed in the switching chamber supported by and in electrical connection with the housing, the movable contact adapted to move into and out of engagement with the stationary contact at predetermined temperature conditions of the thermostatic element characterized in that the cylindrical housing is generally elliptical having a major axis determined by the spacing required between the housing and a thermostatic assembly selected for use with a first range of current ratings of dynamoelectric machines, the housing being useful to house a thermostatic assembly selected for use with both the first range of current ratings and a second lower range of current ratings of dynamoelectric machines, the elliptical configuration providing a reference to enable angular orientation of the housing relative to the header to facilitate assembly of the switch.

6. A thermostatic switch according to claim 5 in which the heater element is symmetrically configured whereby either the first or second end can be secured to the pin member.

7. A thermostatic switch according to claim 5 in which a shelf is formed in the housing wall adjacent to the closed end, the shelf serving as a seat for the stationary contact.

8. A thermostatic switch adapted to be thermally coupled to the windings of a dynamoelectric machine comprising a housing of a thermally and electrically conductive material, the housing being generally cylindrical in configuration and having a first opened end and a second closed end, and defining a switching cavity therein, a header received at and hermetically closing the first opened end of the housing, and an electrically conductive pin member extending through an aperture in the header in electrically insulative relation with the header( the pin member extending into the switching cavity, a thermostatic assembly comprising a heater element having first and second ends, the first end secured to the pin member, a thermostatic element mounted to the heater in heat transfer relation thereto, a movable contact mounted on the thermostatic element, a stationary contact disposed in the switching chamber supported by and in electrical connection with the housing, the movable contact member adapted to move into and out of engagement with the stationary contact at predetermined temperature conditions of the thermostatic element characterized in that cylindrical housing is generally elliptical having a major axis determined by the spacing required between the housing and a thermostatic assembly selected for use with a first range of current ratings of dynamoelectric machines the housing being useful to house a thermostatic assembly selected for use with both the first range of current ratings and a second lower range of current ratings of dynamoelectric machines, the elliptical configuration providing a reference to enable angular orientation of the housing relative to the header to facilitate assembly of the switch.

* * * * *